United States Patent [19]

Siu et al.

[11] 4,177,151

[45] Dec. 4, 1979

[54] FABRIC-CONDITIONING ARTICLE FOR USE IN A CLOTHES DRYER

[75] Inventors: Ting Y. Siu, Englishtown; Daniel Ackley, Waldwick, both of N.J.

[73] Assignee: Tenneco Chemicals, Inc., Saddle Brook, N.J.

[21] Appl. No.: 921,023

[22] Filed: Jun. 30, 1978

[51] Int. Cl.[2] ..... D06M 13/00

[52] U.S. Cl. ..... 252/8.6; 206/0.5; 252/8.8; 427/242

[58] Field of Search ..... 252/8.6, 8.8; 427/242; 206/0.5, 390

[56] References Cited

U.S. PATENT DOCUMENTS

| | | | |
|---|---|---|---|
| 3,442,692 | 5/1969 | Gaiser | 427/242 |
| 3,676,199 | 7/1972 | Hewitt et al. | 427/242 |
| 3,895,128 | 7/1975 | Gaiser | 206/390 |
| 4,049,858 | 9/1977 | Murphy | 252/8.8 |
| 4,057,673 | 11/1977 | Falivene | 427/242 |
| 4,113,630 | 9/1978 | Hagner et al. | 252/8.6 |

*Primary Examiner*—William E. Schulz
*Attorney, Agent, or Firm*—James P. Scullin

[57] ABSTRACT

A fabric-conditioning article useful for treating textile fabrics during the drying cycle in a clothes dryer, to render the fabrics soft and static-free, comprises a sheet of flexible and resilient polyurethane foam at least one side of which has been coated with at least one fabric conditioning agent. The foam sheet is essentially free of conditioning agent in its center core, and preferably is coated on both sides.

23 Claims, 7 Drawing Figures

FABRIC-CONDITIONING ARTICLE FOR USE IN A CLOTHES DRYER

BACKGROUND OF THE INVENTION

1. Field of the Invention

This invention relates to the conditioning, that is, to the improvement of one or more properties, of fabrics in a laundry dryer. More particularly, it relates to an improved fabric-conditioning article in the form of a flexible, resilient, polymeric foam substrate that carries one or more conditioning agents, and to methods for its use and manufacture. The fabric-conditioning article is commingled and tumbled with wet or damp fabrics in a laundry dryer, whereby the conditioning agent is transferred to the fabrics while the fabrics are being dried.

2. Prior Art

It has long been known to condition fabrics, especially, but not limited to, fabrics made from synthetic fibers, by the addition of various chemical compositions to the fiber surfaces. Such compositions, or conditioning agents, include lubricating, bacteriostatic, mothproofing and mildew-proofing agents, and particularly include softening agents and anti-static agents. Conditioning agent compositions frequently comprise mixtures of two or more conditioning agents to accomplish two or more objectives with a single treatment. For example, it is common practice to combine a softener and an anti-static agent into a single fabric conditioning agent.

In laundries, especially in home laundries, an early approach was to add a liquid fabric-conditioner, designed to be substantive to fabrics, to the rinse water during a wash cycle, particularly to the final rinse. Another approach has been to add a fabric-conditioner to the wash water at the beginning of the wash cycle, either separately along with the detergent or as a combination product containing both conditioner and detergent. Neither approach was completely satisfactory due to a number of factors, including the inactivation of cationic fabric-conditioners by small amounts of anionic detergents left in fabrics and in rinse water, inefficient utilization of conditioner, some of which may be incompletely substantive and thus lost down the drain with the rinse water, and unsatisfactory economics because many of the conditioners have limited solubility and are sold as dilute solutions in water or water/alcohol mixtures, which increases packaging and shipping costs. Another negative factor in the case of products added during the rinse cycle is inconvenience, since the housewife must remember to add the fabric-conditioner at the proper stage during the cycle of her otherwise automatic washing machine. To overcome these shortcomings, the art continued to seek more efficient, economical, and convenient ways to package and apply fabric-conditioners especially for use in home laundry appliances.

In U.S. Pat. No. 3,442,692 Gaiser disclosed a method of conditioning fabrics in a heated laundry dryer by tumbling the damp fabrics in contact with a flexible substrate carrying a conditioning agent. Illustratively, the flexible substrate is paper or cloth, which has been thoroughly impregnated with a conditioning agent. In a later related patent, U.S. Pat. No. 3,895,128, Gaiser disclosed a fabric conditioning article comprising a web having a discrete surface coating of a normally-solid fabric softener. Illustratively, the web is a fibrous material such as paper.

In U.S. Pat. No. 3,632,396, Perez-Zamora disclosed a fabric-softening composition consisting essentially of a paper, woven cloth, or nonwoven cloth substrate coated first with a waxy substrate coating to prevent the outer coating from penetrating and becoming entrapped in the substrate, and then coated with an outer coating of a fabric softener.

Hewitt et al, in U.S. Pat. No. 3,676,199, disclosed a method of conditioning by tumbling the damp laundry in contact with an article comprising a form-retaining, or rigid, base with a surface coating of a conditioning agent. The base is, illustratively, a polystyrene foam ball, or a piece of wood, rock, expanded metal, or other foamed plastic.

In U.S. Pat. No. 3,686,025, Morton disclosed a fabric softening composition consisting essentially of a fabric softener impregnated into an absorbent substrate having a defined absorbent capacity and being an adhesively-bonded nonwoven cloth. The disclosure stresses that impregnation, or permeation of the entire substrate structure, rather than coating, is essential in order to avoid staining of fabrics. In a divisional patent, U.S. Pat. No. 3,843,395, Morton disclosed a process for softening freshly washed fabrics in a heated automatic clothes dryer by tumbling the fabrics in contact with the composition of U.S. Pat. No. 3,686,025.

In U.S. Pat. No. 3,870,145, Mizuno disclosed a multi-use reusable article comprising a sponge completely impregnated with a fabric conditioner, which is attached to the wall of a machine dryer.

In U.S. Pat. No. 3,936,538, Marshall et al disclosed a fabric softening composition consisting essentially of a self-supporting pre-formed film comprising a film-forming polymer, a fabric softener, and a waxy surfactant. Also disclosed is a process for softening freshly washed fabrics in a rotary drum clothes dryer comprising drying the fabrics in contact with the self-supporting film.

In U.S. Pat. No. 3,944,694, McQueary disclosed a fabric-conditioning article comprising a flexible web, illustratively a nonwoven cloth, carrying a fabric-conditioning agent, the substrate containing slit openings to permit the flow of air through the substrate during use. In a divisional patent, U.S. Pat. No. 4,012,540, a method of conditioning fabrics in a laundry dryer by commingling the fabrics with the foregoing fabric-conditioning article is disclosed. McQueary disclosed a similar fabric-conditioning article in U.S. Pat. No. 3,956,556, except that the substrate contains perforations rather than slits. The use of the perforated article for conditioning fabrics in a laundry dryer is disclosed in a divisional patent, U.S. Pat. No. 4,007,300.

In U.S. Pat. No. 4,022,938, Zaki et al disclose a fabric softening article, for use in an automatic laundry dryer, comprising a cationic fabric softener, a sorbitan ester, and a dispensing means which is a flexible substrate in sheet configuration. Preferably, the substrate is a sheet of paper or nonwoven cloth into which the softener and sorbitan ester are impregnated. The dispensing means can also be a cloth or paper bag, or a hollow sponge, enclosing the softening mixture.

Murphy, in U.S. Pat. No. 4,049,858, disclosed a non-staining fabric softening article for use in an automatic clothes dryer comprising a mixture of a sorbitan ester and a water-soluble fatty acid soap in combination with dispensing means. Dispensing means can be a sheet of woven cloth, nonwoven cloth, or paper, and can contain slits or holes; and can also be a hollow, open pore, polyurethane sponge pouch or a cloth or paper bag.

An article for conditioning fibrous materials, comprising a solid base coated on at least one side with a continuous coating of a plasticized nonionic, anionic, or cationic surface active agent was disclosed in U.S. Pat. No. 4,057,673 by Falivene. The solid base is a form-retaining material such as a polystyrene foam ball, wood, a light mineral, or other foamed plastic.

SUMMARY OF THE INVENTION

The present invention is designed to overcome the difficulties and shortcomings now encountered in the conditioning of fabrics, particularly in home laundry dryers. Summarizing the invention, it comprises a flexible resilient polyurethane foam substrate which is coated on at least one side with one or more fabric-conditioning agents, but which is not completely impregnated with conditioning agent. Preferably, both sides are coated. The coating, or each coating when both sides of the foam sheet are coated, penetrates the surface of the substrate, to an average depth of no more than about one-third of the thickness of the substrate, leaving the center core of the substrate essentially free from conditioning agent. Preferably, the depth of penetration will not exceed, on the average, one-quarter of the substrate thickness. It will be understood, because of occasional irregularities in the cell structure of polyurethane foam, that there may be occasional and localized areas of deeper penetration, and the presence of such is included within the scope of the invention. On the average the depth of penetration does not exceed one-third, and preferably one-fourth, of the thickness. The coating will be sufficient so that the amount of conditioning agent extracted from a single sheet of the substrate during a drying cycle in a laundry dryer will not contain a large excess of conditioning agent. By this means, it is possible to avoid the wasteful and costly use of excess conditioning agent which is difficult or impossible to usefully extract from the fabric-conditioning articles previously known in the art. When a fabric-conditioning article made according to this invention is placed in a representative laundry dryer and commingled and tumbled with a load of wet or damp fabrics during a representative drying cycle, a high proportion of the contained conditioning agent is transferred from the foam substrate to the fabrics during the early portion of the drying cycle. This is an advantage over prior art fabric-conditioning articles, in that the conditioning agent is more readily transferred from the substrate and distributed evenly throughout the fabrics while the fabrics have a high moisture content. In the later part of the cycle, when the fabrics are dry or nearly dry, transfer and distribution occur less efficiently. Also, the amount of conditioning agent transferred to the fabrics, as a percentage of the total amount originally present on the substrate, is significantly greater than found with prior art materials. Typically, from about 65% to about 90%, or even more, of the total amount of conditioning agent originally on the substrate is transferred to the fabrics being dried. With prior art products which are completely impregnated, or which contain discrete continuous coatings of conditioning agent, it has been found that only much smaller percentages are transferred, from about 23% to about 68% of the total conditioner available. Further, even though such products still contain enough conditioner to treat a second load of fabrics, it has been found that they are generally ineffective in such a second use. The residual conditioning agent remains bound in the interstices, or center core, of the substrate and is unavailable for transfer to the fabrics. Since the cost of the conditioning agent generally is considerably higher than the cost of the substrate, it is evident that the present invention provides an economic advantage in more efficient utilization of the conditioner.

Fabric-conditioning articles made according to this invention have additional advantages due to their physical form. The open-celled structure of the substrate, the interstices of which are not completely filled with impregnant, provides greater air permeability as compared with a relatively dense paper or nonwoven fabric substrate which either has its interstices filled with, or has a discrete, continuous, surface coating of, a conditioning agent. This contributes to the improved rate and degree of release of the conditioning agent, and prevents stoppage of air flow through the dryer in the event that the conditioning article is sucked against the air exhaust port and blocks it. Impairment of air flow out of the exhaust port can markedly reduce drying efficiency, and can cause overheating and an eventual fire.

Since the foam substrate is not completely impregnated, the center core being essentially free of conditioning agent, it retains its original flexibility and resilience to a large degree. The fabric-conditioning articles of this invention can be tightly crumpled and compressed into a ball, and will rapidly return to their original flat sheet form when the compressive force is released. For this reason, they tend to retain their sheet form while being commingled with fabrics in a dryer which aids in efficient release and transfer of the conditioning agent. Also, when these fabric-conditioning articles are flexed during manufacture, die-cutting, packaging, and handling for ultimate deposit in a clothes dryer, there is little or no flaking off or dusting of the conditioning agent. As many as twenty layers of these articles have been plied up and die-cut, without excessive dusting and without having the cut edges fuse together. Immediately after die-cutting, the individual plies were readily separated. By way of contrast, completely impregnated and/or discretely coated paper or nonwoven fabric substrates tend to flake and dust when flexed, die-cut, or otherwised handled; and when tightly crumpled they tend to remain crumpled rather than springing back to their original flat sheet form. Some prior art products which consist of completely impregnated polyurethane foam substrates suffer from the same, and additional, disadvantages. Some of these products produce excessive flaking and dusting during die-cutting. Others are excessively tacky due to their high content of impregnant. When such materials are tightly crumpled and compressed in the hands, they become fused and compacted into a coherent mass which not only does not spontaneously return to its original form, but which is pulled apart and separated only with great difficulty if at all. Should this product be crushed and folded up on itself during tumbling in a dryer, its efficiency in releasing and transferring its contained fabric conditioner would be severely impaired. Another problem occurs when such a product is plied up and die-cut. The cut edges fuse together, making separation of individual layers difficult and slowing down the packaging operation. In addition, the sticking together of the edges has caused consumer dissatisfaction and complaints: two or more sheets stick together and are inadvertently put into the dryer together, leading to the use of an excessive amount of conditioner and to complaints of a short count in the package. All of these problems have been overcome by the present invention.

As a substrate we use a sheet of flexible, resilient, polyurethane foam having a thickness of from about 0.025 inch to about 0.250 inch, and preferably from about 0.070 inch to about 0.095 inch. Foam sheets of greater or lesser thickness can be used if desired, although thicker sheets are less economical and thinner sheets may lack the strength necessary to avoid tearing during manufacture and use of the article. Suitable polyurethane foam can have a density ranging from about 1.1 to about 1.8 lb./cu.ft., with a density of about 1.5 lb./cu.ft. being preferred; and a cell count of from about 20 to about 100 cells per linear inch, with about 50 cells per linear inch being preferred. Suitable polyurethane foam sheets are well known in the art, and the chemical composition and preparation thereof do not per se form a part of the present invention. Polyurethane sheets useful in the practice of this invention can be polyether polyurethane, polyester polyurethane, or polyurethane prepared from mixtures of polyether and polyester polyols. Such sheets are normally prepared in the form of large buns having a rectangular or circular cross-section which are then split or peeled into sheets of suitable thickness. For example, buns having a circular cross-section and suitable for peeling are disclosed in U.S. Pat. No. 3,874,988, to Buff et al. The polyurethane foams can be essentially completely open-celled, such as those disclosed in U.S. Pat. No. 3,748,288 to Winkler et al or U.S. Pat. No. 3,884,848 to Ricciardi et al, or reticulated foams made by any of the reticulation methods known in the art. The foams can also be partly open-celled, or predominantly closed celled. We prefer to use those which are at least partly open-celled.

Polyurethane foam sheets made by splitting or peeling as heretofore described, have discontinuous, partially porous, upper and lower surfaces which make them ideal for use in this invention. A fabric-conditioning agent, or a mixture of two or more fabric-conditioning agents of the same or different types, in the form of a liquid of suitable viscosity, is coated onto at least one surface, and preferably onto both top and bottom surfaces, of the foam sheet in such a manner and in such an amount that the depth of penetration into the foam sheet does not exceed about one-third and preferably about one-fourth of the sheet thickness, leaving at least the center core of the sheet comprising at least about one-third and preferably about one-half of its thickness, uncoated. A suitable viscosity of the fabric-conditioning agent can be attained, if necessary, by the addition of volatile solvents or through the use of heat, or both, as will be well understood by those skilled in the art. The coating is discontinuous, i.e., a continuous film bringing the interstices of the foam surface is not formed, but rather there will be gaps in the coating allowing some circulation of air and volatilization of conditioning agent from the inner portion of the foam sheet. The width of the foam substrate is not critical, and can be varied as desired. Generally, the width will be determined by the width of the coating apparatus employed.

The coating can be applied by any convenient means using any convenient apparatus known in the art, provided that complete impregnation through the thickness of the foam is avoided. Thus, the coating may be applied by knife coating, knife-over-roll coating, reverse roll coating, gravure coating, dip coating with meniscus-forming roll or even brushing or spraying. We prefer to use reverse roll coating, and particularly prefer gravure coating because closer control can be exercised to more precisely deposit a desired amount of conditioning agent and avoid too much penetration below the foam surface. By means of these preferred methods it is possible to accurately meter the desired amount of coating material, which will penetrate the substrate to the desired degree without the application of excess pressure as the coating is applied and without the necessity for any subsequent step to remove any excess conditioning agent. If the coating agent is applied as a solution in a volatile solvent, the solvent will be subsequently removed by evaporation with or without the application of heat as required, before the coated substrate is rolled up for storage, or cut into pieces of suitable size for packaging. Likewise, if the coating is applied as a melt, the coated substrate will be cooled to solidify the coating before rolling up for storage or cutting into pieces for packaging.

The weight of the coating to be applied to the substrate is not critical. It can be varied over a wide range, and it will depend on a number of factors, including: the type and chemical composition of the fabric conditioner to be used; the thickness of the substrate; and the desired length and width of an individual piece of coated substrate which is to be used in a clothes dryer. It will be understood that in general the objective is to provide a fabric-conditioning article, usually a single sheet of coated polyurethane foam, which contains sufficient conditioning agent to treat a dryer-load of fabrics. Obviously, multiple pieces of coated foam sheet can be used if desired. Although, as stated before, the weight of conditioner per unit of substrate is not critical, useful amounts have been found to range from about 0.2 grams to about 10 grams of conditioning agent per piece of foam having dimensions ranging from 6 sq. in. to 144 sq. in. and thickness ranging from 0.025 in. to 0.250 in.

Any of the fabric conditioners which are known in the art to be useful in conditioning fabrics during the drying cycle in a laundry dryer can be used in the practice of this invention. Such conditioning agents include fabric softeners, anti-static agents, optical brighteners, mildewcides and odorants, for example. Mixtures of one or more of the same type of conditioning agent, or of different types, can be employed. The composition of the conditioning agents does not per se form a part of this invention.

Examples of fabric softener and anti-static agent compositions which have been found to be useful in the practice of this invention include, but are not limited to, quaternary ammonium compounds of the generic formula:

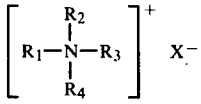

wherein $X^-$ is an anion such as halogen, nitrate, sulfate, or methylsulfate; $R_1$ and $R_2$ are the same or different aliphatic radicals containing from 12 to 22 carbon atoms such as lauryl, cetyl, stearyl, coco, soya, tallow or dihydrotallow; and $R_3$ and $R_4$ are methyl, ethyl, or propyl and can be the same or different; and quaternary imidazolinium compounds of the generic formula:

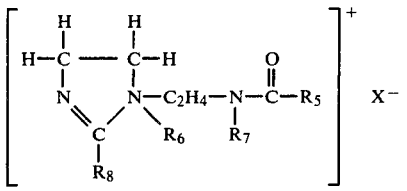

wherein $X^-$ is an anion such as halogen, nitrate, sulfate, or methylsulfate; $R_5$ is an aliphatic radical containing from 11 to 21 carbon atoms; $R_6$ is methyl, ethyl, or propyl; $R_7$ is hydrogen, methyl, ethyl, or propyl; and $R_8$ is an aliphatic radical containing from 12 to 22 carbon atoms, such as coco, soya, tallow, dihydrotallow, lauryl, cetyl, or stearyl.

BRIEF DESCRIPTION OF THE DRAWINGS

For a more complete understanding of the present invention, reference is made to the accompanying drawings in which

FIG. 1 and FIG. 2 depict gravure coating,

FIG. 3 and FIG. 4 depict reverse roll coating,

FIG. 5 depicts gravure coating in tandem, and

FIG. 6 and FIG. 7 depict dip coating with meniscus-forming roll.

Figure 1:
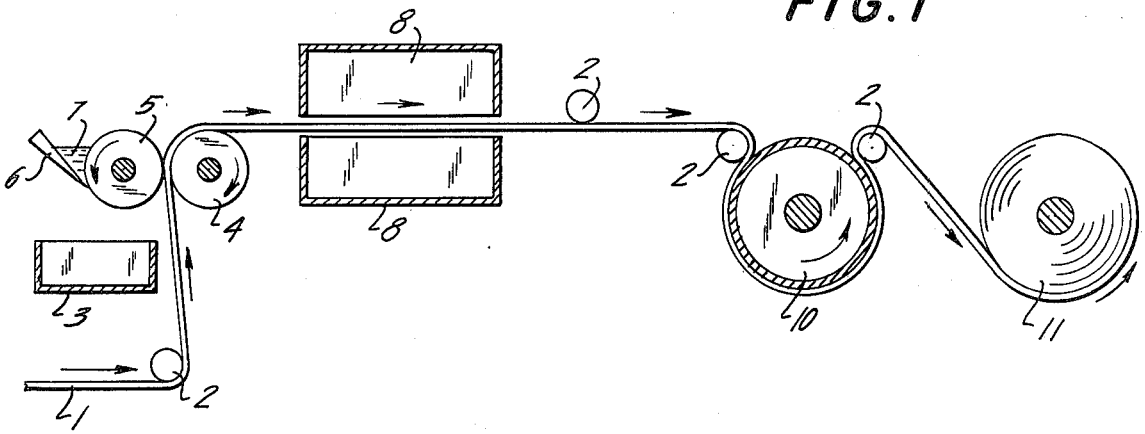
FIG. 1 through FIG. 7 depict in diagrammatic form various different apparatus with which the present invention can be practiced.

In each apparatus depicted, a flexible sheet of polyurethane foam 1 is coated with a liquid fabric-conditioner composition 7, is heated, is then cooled, and is finally wound on wind-up roll 11. Also, in each apparatus depicted in FIGS. 1–4, the numerals 2 represent idler rolls, the numerals 4 represent rolls made of rubber, and the numerals 10 represent cooling cans provided with chilling means.

Figure 2:
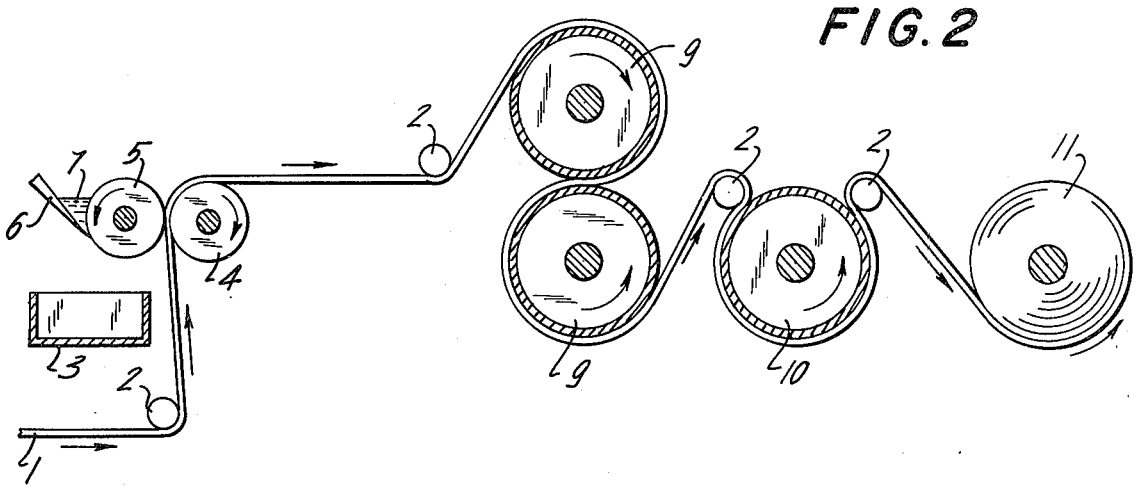

Referring now to FIG. 1 and FIG. 2 in particular, the numerals 3 represent catch pans provided with heating means, the numerals 5 represent gravure rolls (engraving not shown) provided with heating means, and the numerals 6 represent doctor blades, the space between 5 and 6 being a feed trough for fabric-conditioner composition 7.

Figure 3:
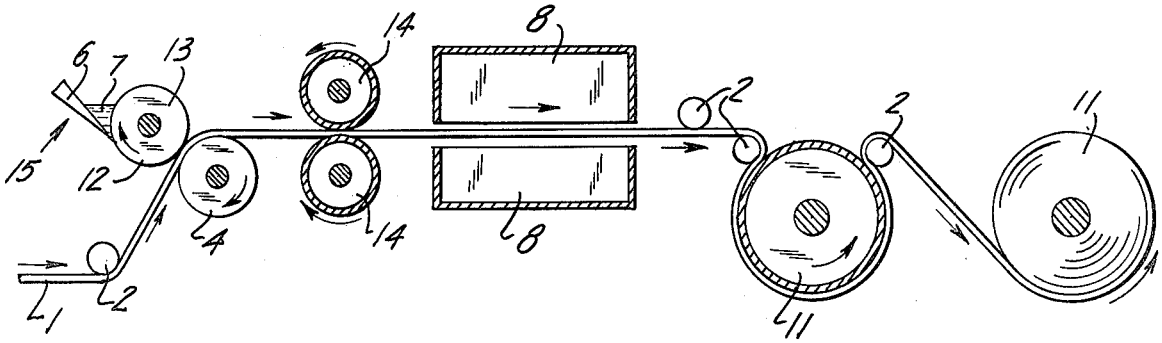
Figure 4:
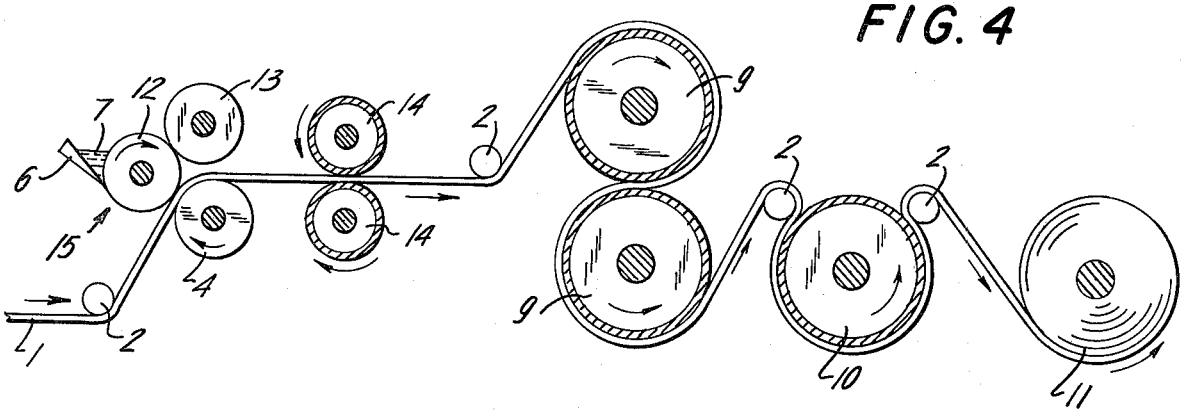

Referring now to FIG. 3 and FIG. 4 in particular, the numerals 12 represent applicator rolls provided with heating means, the numerals 13 represent metering rolls also provided with heating means, the numerals 14, represent nip (squeezing) rolls provided with heating means, and the numerals 15 represent part of a feed trough for fabric conditioner composition 7.

In FIG. 1 and FIG. 3, the numerals 8 represent ovens, and in FIG. 2 and FIG. 4 the numerals 9 represent heating cans.

Figure 5:
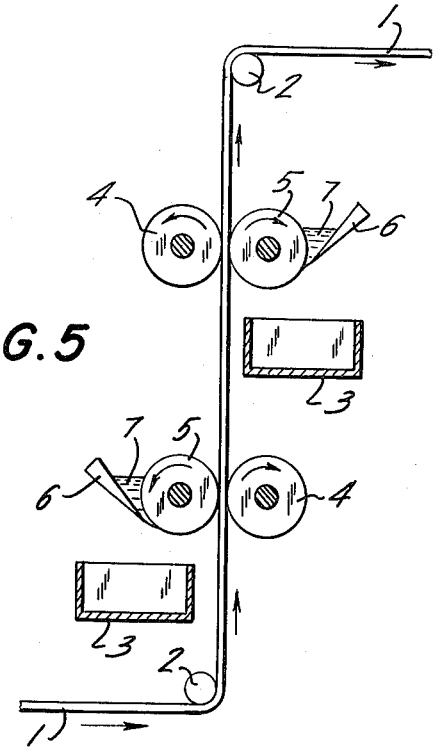

Referring now to FIG. 5 in particular two gravure coaters like those depicted in FIG. 1 and FIG. 2 are shown arranged in tandem, to enable both sides of the foam sheet to be coated in a single pass through the apparatus. The numerals 1 through 7 have the same significance as in FIG. 1 and FIG. 2.

Figure 6:
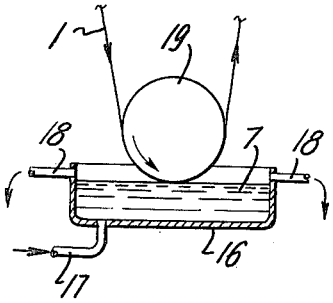
Figure 7:
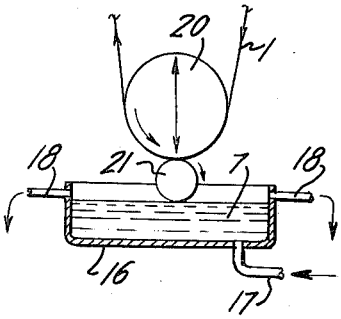

Referring now to FIG. 6 and FIG. 7 in particular, the numeral 1 represents a sheet of flexible polyurethane foam, the numeral 7 represents a liquid coating composition comprising a fabric-conditioner, the numeral 16 represents a trough for coating composition 7, the numeral 17 represents an inlet means for supplying coating composition 7 to trough 16, and the numerals 18 represent overflow outlets for maintaining a constant level of coating composition 7 in trough 16. In FIG. 6, the numeral 19 represents a driven roll for carrying foam substrate 1 over the surface of coating composition 7 and in contact with the surface to a degree just sufficient to form a meniscus of coating composition 7 against foam substrate 1. In FIG. 7 the numeral 20 represents a driven roll carrying foam substrate 1 in meniscus-forming contact with transfer roll 21. Transfer roll 21 contacts the surface of coating composition 7 just sufficiently to form a meniscus due to the surface tension of the coating composition.

It will be understood that when employing the coating apparatus shown in FIG. 5, FIG. 6, or FIG. 7, there may also be employed, in the same sequence, ovens or heating cans, cooling cans, and wind-up rolls as depicted in FIG. 1 through FIG. 4, even though these are not shown.

Of the following examples, some of which are comparative examples according to the prior art and others of which are according to the present invention, the latter are illustrative of the invention but are not limitative thereof.

Examples 1–7 illustrate the performance of fabric-conditioning articles known to the prior art. Performance was evaluated by washing a load of clothes and other fabrics in a representative household washing machine using a representative detergent recommended for home laundry use, and, after completion of a cycle of washing, rinsing and spin drying, transferring the damp fabrics to a representative household electric clothes dryer. A fabric-conditioning article as hereinafter described was then placed on the top of each load of damp fabrics and tumbled therewith during a drying cycle.

The load of fabrics used for each evaluation comprised the following:

(1) 4 hand towels (2 white)

(2) 2 100% nylon half slips (3) 2 swatches (14"×15") of the following:

(A) cotton (B) polyester 100%—green (C) cotton/polyester 65/35

(D) double knit plain (E) 100% acetate fabric (4) 2 lab coats knee type 65/35 cotton/polyester Approx. weight 2.50 lbs. which were then tested as follows:

Procedures:

(1) Set wash cycle for 10 minutes.

(2) Fill washing machine and set for medium load and warm temperature.

(3) Add the materials to be washed to the filled machine.

(4) Add 1 cup (about 40 g) of detergent and start washing.

(5) Transfer to dryer when washing is completed.

(6) Toss a fabric conditioner sheet on top of washed load.

(7) Check wt. of fabric conditioner sheet before being used and every 15 min. for 1 hr. after placed in dryer. Record results. Dryer dial set at normal.

(8) After drying cycle is completed, remove load and test for softening, anti-static and staining, per evaluation methods listed below.

Evaluations:

(1) Softening: Compare the "hand" of the towels against those from Example 3.

(2) Anti-static: check for cling of fabrics to each other when removing dried load. Check for electric static in the following manner: the piece of fabric to be tested (polyester & nylon) is folded twice and rubbed 10 times on the surface of polyurethane ether type foam. The fabric is then immediately placed as close as possible, without touching, to tiny bits of paper. None to very slight attraction of the paper to the fabric is considered good.

(3) Staining: Done visually: no foreign material or stains on fabric, particularly on the white towels and green polyester, is considered good.

The following fabric-conditioning articles were tested by the foregoing method.

Example 1 used a commercially available article which comprised a sheet of completely impregnated non-woven fabric.

Example 2 used a commercially-available article which comprises a sheet of completely-impregnated flexible polyurethane foam. The amount of contained conditioning agent represents the lower limit of the range normally accepted in such commercial products.

Example 3 was the same as Example 2, but contained an amount of conditioner in the middle of the range.

Example 4 was also the same as Example 2, but contained an amount of conditioner representing the upper limit of the range.

Example 5 used another commercially-available article comprising a sheet of completely-impregnated flexible polyurethane foam.

Example 6 used still another commercially-available article, similar to that in Example 5 but from a different manufacturer.

Example 7 used an article comprising a slab of foamed polystyrene coated on one major surface with a continuous coating of the same conditioning agent used in Examples 2–4, according to the teachings of U.S. Pat. No. 3,676,199.

The results from Examples 1–7 are summarized in Table I.

TABLE I

| | Ex. 1 | Ex. 2 | Ex. 3 | Ex. 4 | Ex. 5 | Ex. 6 | Ex. 7 |
|---|---|---|---|---|---|---|---|
| Sheet Size, Inches | 9X11X 0.006 | 2.7X8X 0.085 | 2.7X8X 0.085 | 2.7X8X 0.085 | 2.7X8X 0.085 | 2.7X8X 0.085 | 4.5X4.5X .73 |
| Amount of Conditioner Present, g. | 2.2 | 2.04 | 2.55 | 3.09 | 2.91 | 2.50 | 1.96 |
| Conditioner Extracted After 15 Min., g. | 0.50 | 0.53 | 0.53 | 0.37 | 0.31 | 0.45 | 1.00 |
| Conditioner Extracted After 30 Min., g. | 0.40 | 0.39 | 0.31 | 0.48 | 0.15 | 0.09 | 0.10 |
| Sub. Total Amt. Ext., g. | 0.90 | 0.92 | 0.84 | 0.85 | 0.46 | 0.54 | 1.10 |
| % Ext. | 40.9 | 45.1 | 32.9 | 27.5 | 15.8 | 21.6 | 56.1 |
| Additional Conditioner Extracted after 45 min., g. | 0.22 | 0.30 | 1.27 | 0.32 | 0.12 | 0.10 | 0.05 |
| Additional Conditioner Extracted after 60 min., g. | 0.15 | 0.16 | 0.21 | 0.28 | 0.08 | 0.11 | 0.02 |
| Grand Total Amt. Ext., g. | 1.27 | 1.38 | 1.32 | 1.45 | 0.66 | 0.75 | 1.17 |
| % Ext. | 57.7 | 67.7 | 51.8 | 46.9 | 22.7 | 30.0 | 59.7 |
| Rating | Good | Good | Good | Good | Good | Good | Good |

A rating of "good" indicates that satisfactory properties were imported to the fabrics with respect to softening, freedom from static charge, and freedom from staining. No staining was detected in any of these examples.

Since the residual amount of conditioning agent in the conditioning articles of Examples 1–6 at the conclusion of the test appeared sufficient to treat a second load of laundry, the evaluations were repeated using the same procedures except that the partially-extracted conditioning articles were placed on the damp fabrics. These evaluations were designated Examples 1a through 6a. Visual examination of the used conditioning articles from Example 7, which lost a major portion of the total amount extracted during the first 15 minutes of the drying cycle, showed that the surface coating had been essentially completely removed and that the residual conditioning agent had penetrated into the body of the substrate and was unavailable to perform its intended function.

The results from Examples 1a–6a are summarized in Table II. No staining was observed in any of these examples, but only Example 4a, in which the conditioning article originally contained the highest amount of conditioner, gave satisfactory results in terms of softening and freedom from static charge.

These results illustrate one of the deficiencies of prior art fabric-conditioning articles: an excess of conditioning agent is used but a substantial amount remains entrapped in the substrate, is not transferred to the fabrics being treated, and is thus wasted. In the present invention, more efficient and economical utilization is made of the costly conditioning agent.

TABLE II

| | Ex. 1a | Ex. 2a | Ex. 3a | Ex. 4a | Ex. 5a | Ex. 6a |
|---|---|---|---|---|---|---|
| Sheet Size, Inches | 9X11X 0.006 | 2.7X8X 0.085 | 2.7X8X 0.085 | 2.7X8X 0.085 | 2.7X8X 0.085 | 2.7X8X 0.085 |
| Amount of Conditioner Present, g. | 0.93 | 0.66 | 1.23 | 1.64 | 2.25 | 1.75 |
| Conditioner Extracted After 15 min., g. | 0.14 | 0.20 | 0.26 | 0.39 | 0.21 | 0.10 |
| Additional Conditioner Extracted after 30 min., g. | 0.11 | 0.09 | 0.01 | 0.11 | 0.06 | 0.10 |
| Sub Total Amt. Ext., g. | 0.25 | 0.29 | 0.27 | 0.50 | 0.27 | 0.20 |
| % Ext. | 26.9 | 43.9 | 22.0 | 30.5 | 12.0 | 11.4 |
| Additional Conditioner extracted after 45 min., g. | 0.15 | 0.05 | 0.11 | 0.10 | 0.04 | 0.10 |
| Additional Conditioner Extracted after 60 min., g. | 0.07 | 0.03 | 0.13 | 0.08 | 0.05 | 0.02 |
| Grand Total Amt. Ext., g. | 0.47 | 0.37 | 0.51 | 0.68 | 0.36 | 0.32 |

TABLE II-continued

| | Ex. 1a | Ex. 2a | Ex. 3a | Ex. 4a | Ex. 5a | Ex. 6a |
|---|---|---|---|---|---|---|
| % Ext. | 51.5 | 56.0 | 41.5 | 41.5 | 16.0 | 18.3 |
| Rating | No Good | No Good | No Good | Good | No Good | No Good |

Examples 8–19 illustrate fabric-conditioning articles made according to the present invention. These are replicate runs in which sheets of open-celled polyether polyurethane foam 68 inches wide and 85 mils in thickness, having a density of 1.5 lb./cu.ft. and a cell count of 50, were coated on both sides by means of reverse roll coating. The conditioner composition was a liquid comprised of 95.9 parts by weight of a solution of two fabric softener and anti-static agents, 0.1 parts by weight of an optical brightener sold by Ciba-Geigy Corp. as TINOPAL 5BM M5627, and 4.0 parts by weight of a fragrance. The solution of fabric softener and anti-static agents was comprised of 82.5 parts by weight of a blend of dihydrotallow-dimethylammonium methosulfate and methyl-1-soyaamidoethyl-2-soya imidazolinium methosulfate in a 1/1 by weight ratio and 17.5 parts by weight of isopropanol. In applying the coating, the gap between the applicator roll and the rubber pressure roll was set at 65 mils. The coating was applied to one surface of the foam sheet, the isopropanol was removed by evaporation, the sheet was rolled up, and then was brought back and the process was repeated to coat the reverse side of the sheet with approximately the same amount of conditioning agent. Cut edges of representative samples were examined under an optical microscope to determine and quantitatively measure the extent of penetration of the coating into the body of the foam substrate. With one sample, measurements were made at 64 points along one surface and at 56 points along the opposite surface. Along the first surface the mean depth of penetration was 16.4 mils, with a range of from 7.7 to 29.0 mils and a standard deviation of 4.2 mils at a 95% confidence level. Along the opposite surface the mean depth of penetration was 15.4 mils, with a range of from 6.4 to 29 mils and a standard deviation of 4.9 mils at a 95% confidence level. The coating was seen to be discontinuous, i.e., there were gaps along the outer surfaces where no coating was present, and at no point did the coating penetrate completely through the foam substrate. In other words, the foam was not completely impregnated and the center core area was free from conditioning agent. In similar fashion, measurements were made at 80 points along one surface of a second sample. In this case the mean depth of penetration was 18.1 mils, and the range was from 6.4 to 32.2 mils with a standard deviation of 5.5 mils at a 95% confidence level. Again, at no point was there penetration completely through the foam substrate, and the coating was seen to be discontinuous. All of the coated substrates from Examples 8–19 were examined visually along cut edges, and were found to have depths of penetration essentially the same as those in the preceding samples and to be free from conditioning agent in the center core.

The conditioning articles of Examples 8 through 19 were tested individually using the same evaluation scheme as used in Examples 1–7. In each case, the dimensions of the coated substrate used were 2.7×8×0.085 inches. The results are summarized in Table III.

These results illustrate some of the advantages of the present invention: very efficient use was made of the contained conditioning agent, the amount transferred from the foam substrate to the fabrics being dried ranging from 75.6% to 83.8% of the total amount originally on the substrate. Thus by practicing this invention it is unnecessary to use a large excess of conditioning agent, waste can be held to a very low level, and cost can be reduced. Even though there was no large excess of conditioning agent present in the dryer, the fabrics were satisfactory with respect to softness and freedom from static, and no spotting of the fabrics occurred. Comparison of Example 8, which contained the greatest amount of conditioning agent, with Examples 9–19 shows that even the greater amount initially present was efficiently removed from the substrate by virtue of the fact that it was not bound and entrapped in the interior of the substrate, as it would have been in the case of prior art products using total impregnation rather than surface coating.

A sheet of foam corresponding to Example 12 was crumpled up and squeezed tightly into a ball, by hand. When the squeezing pressure was released, the sheet rapidly and spontaneously regained its original flat configuration. When this procedure was repeated with a sheet of foam corresponding to Example 3, the result was a tightly compacted and coherent mass which did not recover its original flat configuration after release of the pressure. The tacky mass was pulled apart by hand and again spread out into a sheet, with great difficulty.

Examples 20 through 24 are additional comparative examples in which conditioning agent is applied to polyurethane foam sheets, but penetrates through the thickness of the sheets rather than being restricted to the vicinity of the upper and lower surfaces. All of these examples contain the same fabric-conditioning composition.

Example 20 is a control, a foam sheet of dimensions 2.7×8×0.085 inches containing 2.45 g of conditioning agent made by completely impregnating the substrate and then squeezing out the excess. It is essentially a repeat of Example 3.

TABLE III

| | Ex. 8 | Ex. 9 | Ex. 10 | Ex. 11 | Ex. 12 | Ex. 13 | Ex. 14 | Ex. 15 | Ex. 16 | Ex. 17 | Ex. 18 | Ex. 19 |
|---|---|---|---|---|---|---|---|---|---|---|---|---|
| Amt. of Conditioner present, g. | 1.68 | 1.05 | 1.15 | 1.35 | 1.21 | 1.50 | 1.17 | 1.35 | 1.30 | 1.32 | 1.31 | 1.27 |
| Conditioner extracted after 15 min., g. | 0.71 | 0.58 | 0.40 | 0.70 | 0.45 | 0.65 | 0.21 | 0.59 | 0.59 | 0.64 | 0.50 | 0.57 |
| Additional conditioner extracted after 30 min., g. | 0.41 | 0.17 | 0.30 | 0.20 | 0.41 | 0.06 | 0.51 | 0.30 | 0.27 | 0.25 | 0.31 | 0.28 |

TABLE III-continued

| | Ex. 8 | Ex. 9 | Ex. 10 | Ex. 11 | Ex. 12 | Ex. 13 | Ex. 14 | Ex. 15 | Ex. 16 | Ex. 17 | Ex. 18 | Ex. 19 |
|---|---|---|---|---|---|---|---|---|---|---|---|---|
| Sub Total amt. ext., g. | 1.12 | 0.75 | 0.70 | 0.90 | 0.86 | 0.71 | 0.72 | 0.89 | 0.86 | 0.89 | 0.81 | 0.85 |
| % ext. | 66.7 | 71.4 | 60.9 | 66.7 | 71.1 | 47.3 | 61.5 | 65.9 | 66.2 | 67.4 | 61.8 | 66.9 |
| Additional conditioner extracted after 45 min. g. | 0.19 | 0.08 | 0.20 | 0.10 | 0.10 | 0.33 | 0.19 | 0.10 | 0.10 | 0.10 | 0.12 | 0.07 |
| Additional conditioner extracted after 60 min., g | 0.09 | 0.05 | 0.04 | 0.01 | 0.03 | 0.13 | 0.07 | 0.08 | 0.07 | 0.06 | 0.07 | 0.04 |
| Grand Total Amt. Ext., g | 1.40 | 0.88 | 0.94 | 1.11 | 0.99 | 1.17 | 0.98 | 1.07 | 1.03 | 1.05 | 1.00 | 0.96 |
| % Ext. | 83.3 | 83.8 | 81.7 | 82.2 | 81.8 | 78.0 | 83.8 | 79.3 | 79.2 | 80.0 | 76.3 | 75.6 |
| Rating | Good | Good | Good | Good | Good | Good | Good | Good | Good | Good | Good | Good |

Examples 21–24 were prepared by coating each side of a foam sheet by means of a gravure coater equipped with 450 gravure rolls. The depth of penetration of each coat was approximately 50% of the sheet thickness, so that the foam sheet was essentially completely impregnated, but without any large excess of conditioning agent being present as in the case with Example 20.

Example 21 and Example 22 are polyether polyurethane foam sheets having dimensions of 2.7×8×0.085 inches, and containing 1.35 g. and 1.25 g. of conditioning agent, respectively.

Example 23 is a polyester polyurethane foam sheet having dimensions of 2.7×8×0.095 inches and containing 1.36 g. of conditioning agent.

Example 24 is a polyether polyurethane foam sheet having dimensions of 2.7×8×0.055 inches and containing 1.25 g. of conditioning agent.

Examples 20–24 were evaluated using the same procedures as used for Examples 1–7. The results are summarized in Table IV.

These results show that, even though in all cases satisfactory softness and freedom from static charge was imparted to the fabrics and no spotting was observed, the utilization of total available conditioning agent was less than that found with the previous examples, that were according to the invention. The total extracted in Examples 21–24 ranged from 48.8% to 62.4% of the amount originally present, showing that a substantial amount was wastefully entrapped in the interior of the substrate.

Examples 25–33 also illustrate fabric-conditioning articles made according to the invention. The coating composition was the same as that used in Examples 8–19, except that a slightly greater amount of fragrance was used.

TABLE IV

| | Ex. 20 | Ex. 21 | Ex. 22 | Ex. 23 | Ex. 24 |
|---|---|---|---|---|---|
| Amount of Conditioner present, g. | 2.45 | 1.35 | 1.25 | 1.36 | 1.25 |
| Conditioner extracted after 15 min., g. | 0.30 | 0.38 | 0.26 | 0.26 | 0.35 |
| Additional conditioner extracted after 30 min., g. | 0.30 | 0.30 | 0.17 | 0.28 | 0.21 |

TABLE IV-continued

| | Ex. 20 | Ex. 21 | Ex. 22 | Ex. 23 | Ex. 24 |
|---|---|---|---|---|---|
| Sub Total Amt. Ex., g. | 0.60 | 0.68 | 0.43 | 0.54 | 0.56 |
| % Ext. | 24.5 | 43.6 | 34.4 | 39.7 | 44.8 |
| Additional conditioner extracted after 45 min., g | 0.1 | 0.01 | 0.11 | 0.12 | 0.12 |
| Additional conditioner extracted after 60 min., g. | 0.15 | 0.10 | 0.07 | 0.10 | 0.10 |
| Grand Total Amt. Ext., g. | 0.85 | 0.79 | 0.61 | 0.76 | 0.78 |
| % Ext. | 34.7 | 58.5 | 48.8 | 55.9 | 62.4 |
| Rating | Good | Good | Good | Good | Good |

The substrate was a sheet of open-celled polyether polyurethane foam having a thickness of 85 mils, a density of 1.5 lb./cu.ft., and a cell count of about 50 per linear inch. The apparatus comprised two gravure coaters in tandem, as depicted in FIG. 5, so that both sides of the substrate were coated in a single pass. Both coaters were equipped with 45 Q gravure rolls, and the gap between the gravure roll and the rubber roll was set at 65 mils at both stations. After coating, the isopropanol was removed by evaporation and the cooled sheet was rolled up. Individual pieces 2.7 by 8 inches were die-cut from the sheet at random, and identified as Examples 25 through 33. These were evaluated as was done for Examples 1–7, and the results are summarized in Table V. Two additional samples cut at random from the coated sheet were examined in cross-section along an edge by means of an optical microscope, to determine the depth of penetration of the coating. On one of these, 56 measurements were taken, and showed a mean value of 15.5 mils, a range of from 5.8 to 31.0 mils, and a standard deviation of 6.6 mils at a 95% confidence level. On the second, 59 measurements were taken, and showed a mean value of 19.0 mils, a range of from 8.4 to 30.3 mils, and a standard deviation of 6.9 mils at a 95% confidence level.

A cut edge of the sheet was examined under ulta-violet light with the naked eye. Due to the presence of an optical brightener in the fabric conditioner composition, the depth of penetration of the coating was easily discernible. It was apparent that the center core amounting to about 50% of the thickness of the sheet was free of the fabric conditioner.

TABLE V

| Example No. | 25 | 26 | 27 | 28 | 29 | 30 | 31 | 32 | 33 |
|---|---|---|---|---|---|---|---|---|---|
| Amount of conditioner present,g. | 1.30 | 1.16 | 0.71 | 1.02 | 1.08 | 1.10 | 0.78 | 0.82 | 1.23 |
| Conditioner extracted after 15 min., g. | 0.63 | 0.63 | 0.49 | 0.45 | 0.63 | 0.63 | 0.44 | 0.48 | 0.60 |

TABLE V-continued

| Example No. | 25 | 26 | 27 | 28 | 29 | 30 | 31 | 32 | 33 |
|---|---|---|---|---|---|---|---|---|---|
| Additional conditioner extracted after 30 min., g. | 0.28 | 0.24 | 0.12 | 0.23 | 0.19 | 0.18 | 0.14 | 0.14 | 0.31 |
| Sub-Total Amt. Ext., g. | 0.91 | 0.87 | 0.61 | 0.68 | 0.82 | 0.81 | 0.58 | 0.62 | 0.91 |
| % Ext. | 70.0 | 75.0 | 86.0 | 66.7 | 75.9 | 73.6 | 74.4 | 75.6 | 74.0 |
| Additional Conditioner extracted after 45 min., g. | 0.15 | 0.10 | 0.04 | 0.10 | 0.09 | 0.10 | 0.05 | 0.05 | 0.10 |
| Additional Conditioner extracted after 60 min., g. | 0.04 | 0.04 | 0.02 | 0.05 | 0.04 | 0.05 | 0.01 | 0.01 | 0.05 |
| Grand Total Amt. Ext., g. | 1.10 | 1.01 | 0.67 | 0.83 | 0.95 | 0.96 | 0.64 | 0.68 | 1.06 |
| % Ext. | 84.6 | 87.0 | 94.4 | 81.2 | 88.0 | 87.3 | 82.1 | 82.9 | 86.2 |
| Rating | Good | Good | Good | Good | Good | Good | Good | Good | Good |

Examples 34–42 are further examples of fabric conditioning articles according to the invention. The coating composition was the same as that used for Examples 8–19. The substrate was a polyether polyurethane foam having the same characteristics as that used for Examples 25–33, but having a thickness of 82 mils.

Both surfaces were coated with approximately the same amount of fabric conditioner, by means of two passes through a single station gravure coater equipped with a 65Q gravure roll. The gap between the rubber roll and the gravure roll was set at 30 mils, to produce a slightly deeper degree of penetration of the coating. After coating, the isopropanol was removed by evaporation and the coated substrate was rolled up. Individual pieces measuring 6×3.6 inches were die-cut at random, and identified as Examples 34 through 42. These were evaluated for efficiency in conditioning fabrics following the same procedure as was used for Examples 1–7, and the results are summarized in Table VI.

An additional sample cut at random from the coated sheet was examined in cross-section along an edge by means of an optical microscope. Measurements were made at 56 points, and showed a mean value for depth of penetration of 23.4 mils, a range of from 9.7 to 45 mils, and a standard deviation of 8.8 mils at a 95% confidence level. Inspection of a cut edge with the naked eye, under ulta-violet illumination, showed clearly that the center-core was free of fabric conditioner although the average depth of penetration from each surface was somewhat greater than that found with the coated sheet from Examples 25–33. It was estimated that the thickness of the uncoated center core amounted to slightly more than one-third of the total substrate thickness, and that this coated foam sheet was thus within the scope of the invention. Comparison of the data in Table VI with that in Table I shows that Examples 34–42 were generally more efficient in releasing fabric conditioner than prior art materials. Comparison of the data of Tables VI and V shows that Examples 34–42 were slightly less efficient in releasing fabric conditioner than Examples 25–33, which is consistent with the slightly greater average degree of penetration of the coating in Examples 34–42.

TABLE VI

| Example No. | 34 | 35 | 36 | 37 | 38 | 39 | 40 | 41 | 42 |
|---|---|---|---|---|---|---|---|---|---|
| Amount of Conditioner present, g. | 0.78 | 0.72 | 0.91 | 0.75 | 0.90 | 0.82 | 0.95 | 0.81 | 0.87 |
| Conditioner Extracted After 15 min., g. | 0.29 | 0.34 | 0.36 | 0.35 | 0.29 | 0.32 | 0.31 | 0.30 | 0.30 |
| Additional Conditioner Extracted After 30 min., g. | 0.14 | 0.13 | 0.18 | 0.12 | 0.16 | 0.10 | 0.19 | 0.13 | 0.15 |
| Sub-total Amt. Ext., g. | 0.43 | 0.47 | 0.54 | 0.47 | 0.45 | 0.42 | 0.50 | 0.43 | 0.45 |
| % Ext. | 55.1 | 65.2 | 59.3 | 62.6 | 50.0 | 51.2 | 52.6 | 53.1 | 51.7 |
| Additional Conditioner Extracted After 45 min., g. | 0.08 | 0.06 | 0.09 | 0.06 | 0.09 | 0.08 | 0.11 | 0.07 | 0.07 |
| Additional Conditioner Extracted After 60 min., g | 0.03 | 0.02 | 0.08 | 0.04 | 0.09 | 0.04 | 0.05 | 0.04 | 0.04 |
| Grand Total Amt. Ext. g. | 0.54 | 0.58 | 0.71 | 0.57 | 0.63 | 0.54 | 0.66 | 0.54 | 0.56 |
| % Ext. | 69.2 | 80.1 | 78.0 | 76.0 | 70.0 | 65.9 | 69.5 | 66.7 | 64.4 |
| Rating | Good | Good | Good | Good | Good | Good | Good | Good | Good |

What is claimed is:

1. In a fabric-conditioning article comprising a flexible substrate carrying at least one fabric-conditioning agent and suitable for use by commingling with damp fabrics in a laundry dryer, the improvement wherein said substrate comprises a sheet of flexible, resilient, polyurethane foam having a density of from about 1.1 to about 1.8 pounds per cubic foot, a thickness of from about 0.025 inch to about 0.250 inch and a cell count of from about 20 to about 100 cells per linear inch, and at least one surface of said foam sheet has a discontinuous coating of said fabric- conditioning agent, said coating penetrating said surface to an average depth of no more than about one-third the thickness of said sheet without extending appreciably above said surface and at least the center core of said sheet being free from said fabric-conditioning agent, the improvement providing more efficient utilization of said fabric-conditioning agent.

2. A fabric-conditioning article according to claim 1 wherein both top and bottom surfaces of said sheet have a discontinuous coating of fabric-conditioning agent, each of said coatings penetrating said surface to an average depth of no more than about one-third the thickness of said sheet without extending appreciably above said surface and the core of said sheet being free from said fabric-conditioning agent.

3. A fabric-conditioning article according to claim 1 or claim 2 wherein said coating or each of said coatings penetrates to an average depth of no more than about one-fourth the thickness of said sheet.

4. A fabric-conditioning article according to claim 1 whrein said polyurethane foam has a density of from about 1.4 to about 1.6 pounds per cubic foot, a thickness of from about 0.070 inch to about 0.095 inch, and a cell count of from about 40 to about 60 cells per linear inch.

5. A fabric-conditioning article according to claim 1 wherein said polyurethane foam is a polyether polyurethane.

6. A fabric-conditioning article according to claim 1 wherein said polyurethane foam is a polyester polyurethane.

7. A fabric-conditioning article according to claim 1 wherein said polyurethane foam is prepared from a mixture of polyether polyols and polyester polyols.

8. A fabric-conditioning article according to claim 1 wherein said conditioning agent comprises a fabric softener.

9. A fabric-conditioning article according to claim 1 wherein said fabric-conditioning agent comprises a fabric softener and an anti-static agent.

10. A fabric-conditioning article according to claim 9 wherein said fabric-conditioning agent also comprises a fragrance.

11. A fabric-conditioning article according to claim 9 wherein said fabric-conditioning agent also comprises an optical brightener.

12. A method for the manufacture of a fabric-conditioning article suitable for use by commingling with damp fabrics in a laundry dryer, which comprises forming a discontinuous coating of at least one fabric-conditioning agent on at least one surface of a sheet of flexible, resilient, polyurethane foam, said coating penetrating said surface to an average depth of no more than about one-third the thickness of said sheet without extending appreciably above said surface and leaving at least the center core of said sheet free from said fabric conditioner.

13. A method according to claim 12 wherein said coating is formed on both top and bottom surfaces of said sheet, each of said coatings penetrating said surfaces to an average depth of no more than about one-third the thickness of said sheet without extending appreciably above said surface and the core of said sheet being free from said conditioning agent.

14. A method according to claim 12 or claim 13 wherein said coating or each of said coatings penetrates to an average depth of no more than about one-fourth the thickness of said sheet.

15. A method according to claim 12 which comprises the additional step of removing volatile solvent from said coating by means of evaporation.

16. The method of claim 12 wherein said coating is applied by a continuous process.

17. The method of claim 13 wherein both coatings are applied in a single, continuous, operation.

18. The method of claim 16 wherein the continuous process is reverse coil coating.

19. The method of claim 16 wherein the continuous process is gravure roll coating.

20. The method of claim 16 wherein the continuous process is dip coating with meniscus-forming roll.

21. In a method of conditioning fabrics by commingling a fabric-conditioning article with damp fabrics and tumbling in a heated laundary dryer whereby a fabric-conditioning agent is transferred from said fabric-conditioning article to said fabrics while said fabrics are being dried, the improvement which comprises employing as the fabric-conditioning article a sheet of flexible, resilient, polyurethane foam carrying a sufficient amount of at least one fabric-conditioning agent to condition said damp fabrics commingled therewith, said fabric-conditioning agent being carried as a discontinuous coating on at least one surface of said polyurethane foam sheet, said coating penetrating the surface of said sheet to an average depth of no more than about one-third the thickness of said sheet without extending appreciably above said surface and at least the center core of said sheet being free from said fabric-conditioning agent.

22. A method according to claim 21 wherein said fabric-conditioning agent is carried as a discontinuous coating on both top and bottom surfaces of said sheet, each of said coatings penetrating said surfaces to an average depth of no more than about one-third the thickness of said sheet without extending appreciably above said surface and the core of said sheet being free from said fabric-conditioning agent.

23. A method according to claim 21 or claim 22, wherein the average depth of penetration of said coating or each of said coatings is no more than about one-fourth the thickness of said sheet.

* * * * *

UNITED STATES PATENT AND TRADEMARK OFFICE

CERTIFICATE OF CORRECTION

PATENT NO. : 4,177,151

DATED : December 4, 1979

INVENTOR(S) : Ting Y. Siu and Daniel Ackley

It is certified that error appears in the above-identified patent and that said Letters Patent are hereby corrected as shown below:

Column 5, line 56, change "bringing" to --bridging--;

Column 10, Table I, 7th Line under Example 3, change "1.27" to --0.27-- ;

Column 10, line 33, change "articles" to --article--;

Column 13, line 19, change "450" to 45 Q--.

Signed and Sealed this

*Twenty-fifth* Day of *March 1980*

[SEAL]

*Attest:*

SIDNEY A. DIAMOND

*Attesting Officer*

*Commissioner of Patents and Trademarks*